United States Patent [19]

Peffer et al.

[11] 4,213,603

[45] Jul. 22, 1980

[54] METHOD AND APPARATUS FOR LOCATING A MOVING SHEET AT A REGISTRATION POSITION

[75] Inventors: Robert M. Peffer, Penfield; Charles H. Braun, Webster, both of N.Y.

[73] Assignee: Eastman Kodak Company, Rochester, N.Y.

[21] Appl. No.: 915,646

[22] Filed: Jun. 15, 1978

[51] Int. Cl.[2] ..... B65H 9/14

[52] U.S. Cl. ..... 271/229; 271/245

[58] Field of Search ..... 271/229, 230, 231, 245, 271/182

[56] References Cited

U.S. PATENT DOCUMENTS

| | | | |
|---|---|---|---|
| 4,076,408 | 2/1978 | Reid | 355/14 |
| 4,135,804 | 1/1979 | Schoppe | 271/229 |

FOREIGN PATENT DOCUMENTS 835568 5/1976 Belgium .

*Primary Examiner*—Richard A. Schacher
*Attorney, Agent, or Firm*—Lawrence P. Kessler

[57] ABSTRACT

A method and apparatus for locating sheets moving in a path at a registration position in the path. The sheets, moving seriatim in a path established by a guide and a platen of a reproduction apparatus, are pinched against the platen to decelerate the sheets as they approach the registration position for copying. The pinching action is accomplished by deflecting a resilient member into the path into juxtaposition with the platen. The member covers an opening in the guide and is deflected by a mechanism extensible through the opening. In its deflected position, the member exerts a deceleration force on the sheet to retard the sheet as it approaches the registration position. The deceleration force has a component that is substantially parallel to the surface of the sheet and a component that is substantially normal to the surface and of greater magnitude than the parallel component. The deflected member is configured relative to the path such that the magnitudes of the components increase as the sheet approaches the registration position. Since the member covers the opening in the guide, it serves to optically mask the opening during the copying of the sheet at the registration position.

12 Claims, 5 Drawing Figures

METHOD AND APPARATUS FOR LOCATING A MOVING SHEET AT A REGISTRATION POSITION

BACKGROUND OF THE INVENTION

1. Field of the Invention

This invention relates generally to sheet registration, and more particularly to a method and apparatus for locating a sheet moving in a path at a registration position in the path.

2. Description of the Prior Art

It is a common practice in modern reproduction equipment such as printers or copier/duplicators, to deliver discrete sheets seriatim to a station at which the sheets are registered and a function is performed thereon. The function may be, for example, printing an image on the sheet or obtaining an image of information contained on the sheet to enable a copy thereof to be reproduced. In either case proper location of a sheet in the registration station is essential to obtaining accurate image reproduction. As efficiency of operation or speed of the reproduction equipment is increased in order to improve productivity, registration of the sheets becomes more difficult (e.g., must be accurately carried out in a shorter span of time), but no less critical.

A recent innovative apparatus for use with electrophotographic copier type reproduction equipment improves productivity by enabling the copier to make multiple copy sets of a multi-page document in page sequential order. The apparatus which is described in Belgian Pat. No. 835,568 (issued May 13, 1976 and U.S. Pat. No. 4,076,408 (issued Feb. 28, 1978 in the name of Reid et al, and assigned to Eastman Kodak Company), delivers discrete pages of the document seriatim from a document stack to the copier, whereat copies of the pages are made in the order received, and returns the pages to the stack. Because the document pages are continuously circulated to and from the stack until the desired number of copy sets are made, this apparatus is called a recirculating document feeder.

The document copying cycle utilizing the recirculating document feeder is more particularly described as follows: With the document pages stacked in page sequential order, information side up, in a supply hopper of the recirculating document feeder, successive pages of the document are removed from the bottom of the stack and fed seriatim, information side down, to the platen of the electrophotographic copier. The recirculating document feeder has a base plate overlying the platen to guide the pages in a travel path across the platen. Each page, in turn, is stopped and registered on the platen by registration gates located transverse to the page travel path across the platen and extending through openings in the base plate. The registered page is exposed by an illumination source within the copier to obtain an image of the page. The image is processed by the copier to make a copy of that page. After each page is exposed, the registration gates move out of the travel path and the page is fed back to the hopper and deposited on top of document pages remaining in the hopper. Recirculation of the discrete pages continues until the desired number of complete copy sets of the document have been made.

While registration gates as shown in the Belgian Patent have proven effective for proper page registration, other incidental aspects of their operation under certain conditions do not perform entirely in an optimum desired manner. For example, when a document page is slightly mis-registered (i.e., not in engagement with all of the registration gates), the openings in the base plate through which the non-contacted gates extend form a light trap. This causes an image of the opening to appear as an objectionable black artifact on the copy of the document page. Furthermore, the lead edge of the document page is not under control when it engages the gates. If the page is not flat against the platen during exposure, the image of the information on the page in the non-flat area may not be in focus. Additionally, the lead edge of light-weight document pages may be damaged as the page is driven into the registration gates, and heavyweight document pages may interfere with retraction of the registration gates out of the travel path after exposure.

SUMMARY OF THE INVENTION

In accordance with the present invention a method and apparatus are provided for locating a moving sheet at a registration position in a path, such as, for example, a sheet fed by a recirculating document feeder to the platen of an electrophotographic copier in the manner described above. The path of movement for the sheet is defined by a guide and a parallel support. A resilient member is selectively moved into the path upstream of the registration position for applying a deceleration force to a surface of the sheet which is parallel to the support. The resilient member may, for example, cover an opening in the guide; and movement of the resilient member into the path is controlled in synchronism with the movement of the sheet in the path by, for example, an actuator extensible through the opening. The deceleration force applied to the surface of the sheet urges the sheet against the support to retard the sheet as it approaches the registration position. More particularly, the deceleration force has a component that is substantially parallel to the surface and a component that is substantially normal to the surface and of greater magnitude than the parallel component. The resilient member, when deflected into the path, is configured relative to the path such that the magnitudes of the components increase (for example, at different rates) as the sheet approaches the registration position. Since the resilient member covers the opening in the guide, it may additionally serve to optically mask the opening.

The invention, and its objects and advantages, will become more apparent in the detailed description of the preferred embodiments presented below.

DESCRIPTION OF THE PREFERRED EMBODIMENTS

Figure 1:
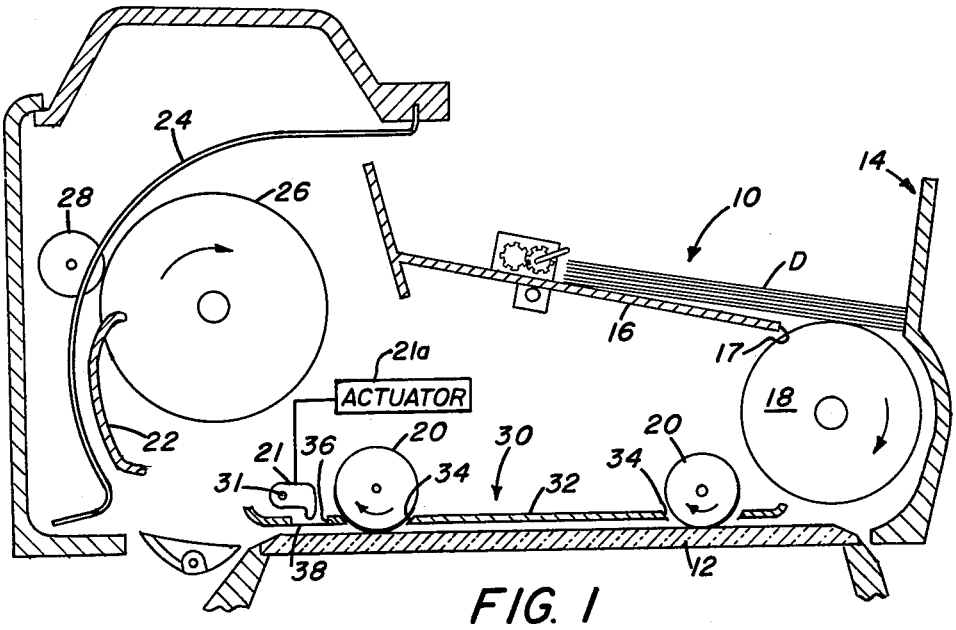
FIG. 1 is a side elevational view, in section, of a document feeder incorporating the sheet locating apparatus of this invention, portions being removed to facilitate viewing.

FIG. 1 shows, in somewhat simplified form, the recirculating document feeder 10 of the aforementioned Belgian Pat. No. 835,586, and U.S. Pat. No. 4,076,408 the feeder being mounted to overlie a transparent glass platen 12 of a document copier (not shown). The recirculating document feeder of that patent and its operation are described herein only to the extent necessary for a complete understanding of the instant invention. It is of course understood that while this invention is described in relation to the recirculating document feeder of the Belgian patent, it could also be incorporated in any other apparatus which locates a sheet moving in a path at a registration position in the path.

The feeder 10 includes a frame 14 within which a document hopper 16 is mounted. When it is desired to make one or more sets of copies of a multi-page document D, bearing information on one side of each page (sheet), the document is stacked in the hopper 16 in page sequential order, information side up, first numerical page on top. A feed mechanism 18 (such as an oscillating vacuum feeder) is located adjacent to an opening 17 in the forward end of the hopper 16. When the document copying cycle is initiated, the feed mechanism 18 removes the bottom page of the document from the hopper and transports the page, information side down, in a travel path to the platen 12.

Figure 2:
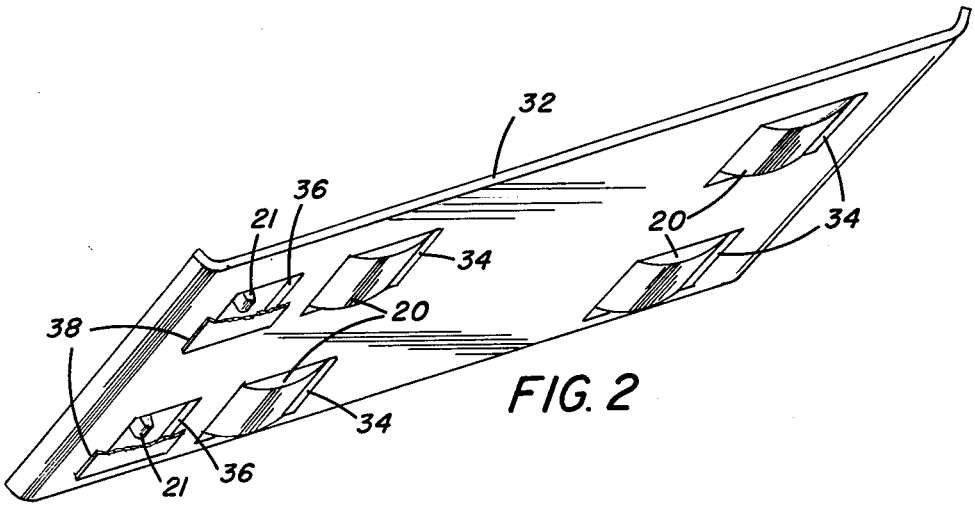
FIG. 2 is a bottom view in perspective of the guide plate and registration gate opening cover members of the sheet locating apparatus, with portions broken away to facilitate viewing.

A transport and registration mechanism 30 transports the pages across the platen 12 and stops and registers the pages in a registration position on the platen for copying. The mechanism 30 includes rotating drive rollers 20 overlying the platen. The rollers 20, which are driven by a motor (not shown), frictionally engage the page to position the page on the platen against a pair of registration gates 21 transverse to the travel path. In order to assure proper feeding of the document pages across the platen 12, a guide plate 32 is connected to the frame 14 in spaced relationship substantially coextensive with the platen to define the document travel path therebetween. The guide plate 32 has a plurality of openings 34 through which the rollers 20 extend (see FIG. 2) so as to be disposed to transport the pages along the travel path. Additonally, the plate 32 has a pair of openings 36 adjacent to one edge of the platen 12 transverse to the travel path and on opposite sides of the centerline of the path. The registration gates 21 are disposed on the opposite side of the plate 32 from the travel path. The gates 21 are of an L-shaped configuration and formed of a relatively rigid material such as metal or hard plastic to effect stopping of a page brought into contact therewith. Actuators 21*a* pivot the gates about axis 31, from their retracted position, for extension through the openings 36 in synchronized relation to the feeding of a page from the hopper 16 to intercept the page in the travel path to stop the page, in proper alignment relative to the centerline of the path, at a registration position on the platen during exposure. In other types of sheet locating apparatus, the sheet need not be stopped in the registration position but only slowed to such speed that enables a non-smeared image of the page to be obtained.

When the document page is registered against the gates 21, it is illuminated by a light source in the copier to obtain a reflected light image of the page which is reproduced on a copy receiving sheet. In an electrophotographic copier, the reflected light image exposes a charged photoconductive member to form a latent electrostatic image of the document page. The electrostatic image is then processed to obtain a copy of that page on a copy receiving sheet. Of course different reproduction processes are employed in other types of copiers such as, for example, microfilmers or facsimile apparatus. Once the requisite image of the document page is obtained, the actuators move the registration gates 21 out of the travel path (as by pivoting the gates about their respective axes 31) and rollers 20 frictionally drive the page from the platen into a return path formed by guides 22 and 24 fixed to the frame 14. In the return path, a roller 26 driven by a motor (for example, the same motor which drives rollers 20) cooperates with a nip roller 28 to transport the page along the return path and back into the hopper 16 where it is deposited on top of the other pages of the document D. The described cycle is repeated for each succeeding page of the document D with recirculation being at a rate compatible with the most efficient copy rate of the copier.

With past transport and registration mechanisms, the page being copied may not lie flat on the platen adjacent to the registration mechanism. Additionally, lightweight document pages transported in the travel path across the platen may suffer lead edge damage upon striking the registration gates; and heavyweight document pages may interfere with the pivoting of the gates upon retraction of the gates out of the travel path after exposure. Furthermore, as the document page is transported along the travel path, it may become skewed relative to the direction of travel to arrive at the registration position out of alignment. The skewing of the page may cause the page to only engage one of the registration gates when it is stopped on the platen for exposure. If the document is not accurately registered against all of the gates, the opening through which the non-engaged gate extends may function as a light trap during exposure such that a copy of the document page will have an objectionable black artifact corresponding to the opening reproduced thereon.

Figure 5:
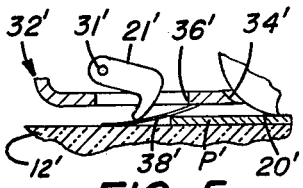
FIG. 5 is a side elevational view, in section, on an enlarged scale, similar to FIG. 4 of an alternate embodiment of the cover member.

To overcome these potential problems, cover members 38 formed of any known resilient material are fixed to the plate 32 over the openings 36 to be interposed between the registration gates and the travel path. The cover members 38 of the embodiment of FIG. 3 (one shown) are formed of a thin sheet material having a low coefficient of friction and a highly reflective (specular or white) surface finish. The sheet material is preferably a resilient flexible membrane made of, for example, polyester, polyvinylfloride or polyvinylchloride, fixed to the plate 32 adjacent to the marginal edges of the respective openings 36. In the embodiment of FIG. 5, the cover members 38′ (one shown) are alternatively formed of resilient metal, paper or fiberboard hinged to the plate 32′ adjacent to the upstream transverse marginal edge of the respective openings 36′.

By completely covering the openings 36 (36′), the cover members 38 (38′) form an optical mask for the openings. As such, if the page of the document is not accurately registered against a gate, light emitted from the source is reflected from the cover member. In the electrophotographic copier the reflected light exposes the corresponding area of the photoconductor so as to be reproduced as a white area on the page copy, rather than being trapped by the opening to produce an objectionable black artifact on the page copy.

Figure 3:
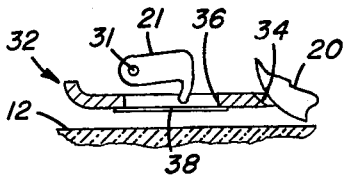
FIG. 3 is a side elevational view, in section, on an enlarged scale of a portion of FIG. 1 showing one registration gate opening and registration gate in its retracted position.
Figure 4:
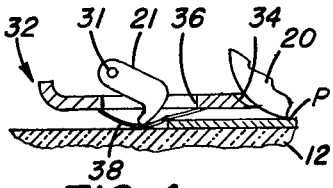
FIG. 4 is a side elevational view, in section, on an enlarged scale, similar to FIG. 3 with the one registration gate shown in its extended document page-registering position.

As best seen in FIGS. 3 and 4, or 5 when the registration gates 21 (21') are pivoted from their retracted position out of the travel path (FIG. 3) to their position intercepting the travel path (FIGS. 4 or 5), the cover members 38 (38') are deflected by the gates into the travel path into juxtaposition with the platen 12 (12'). It is, of course, apparent that any other equivalent mechanism (e.g., mechanical linkage or pneumatic or hydraulic piston) may alternatively be used to deflect the cover members 38 (38'). With the cover members in their deflected position, they engage a page (designated as P in FIG. 4 and P' in FIG. 5) moving in the travel path upstream of the registration position. The engagement, which occurs on the surface of the page at the lead edge thereof pinches the page against the platen causing a deceleration force to be exerted on the page to retard the page as it approaches the registration position. The force has a component that is substantially parallel to the surface of the page and a component that is substantially normal to the surface and of greater magnitude than the parallel component.

Since the cover members are configured by the registration gates to intercept the travel path at an angle thereto, the magnitude of the components of the force exerted by the cover members on the page increase at different rates as the page moves in the direction toward the registration gates. In the embodiment of FIG. 4, resilient flexible membrane cover members 38 stretch upon contact with the moving page to more nearly conform to the shape of the lead edge of the page. With this configuration the magnitude of the parallel component increases at a faster rate than the magnitude of the normal component. In the embodiment of FIG. 5, the angle of the hinged cover member 38' with respect to the travel path causes the cover members to contact the page such that the magnitude of the normal component increases at a faster rate than the magnitude of the parallel component. The increase in the magnitudes of the deceleration force components further retards the page to ultimately locate the page at the registration position. When the registration gates 21 (21') return to their retracted position, the flexible cover members 38 (38') return to their position out of the travel path so that the cover members are disengaged from the page. Thus the cover members do not impede movement of the page as it is fed from the platen by drive rollers 20 (20'). While only location of a single page has been described, it is of course apparent that the actuation of the registration gates in synchronism with the feeding of pages from the hopper 16 causes the cover members to locate the pages sequentially at the registration position.

In both embodiments, the cover members control the lead edge of the page being located to urge the page against the glass platen. This insures that the page is always properly positioned to lie flat on the platen. Furthermore, the inclusion of a normal component in the deceleration force reduces the magnitude of the parallel component which would be necessary to act on the page to effect location at the registration position if a force with only a parallel component were used to locate the page, and accordingly, reduces potential damage to the lead edge by such force. Additionally, the interposition of the cover members between the page and the registration gates provides just enough clearance between the page and the gates to register the page within the registration tolerance limits and enables the gate to pivot out of the travel path without interference from the page.

The invention has been described in detail with particular reference to the preferred embodiments thereof, but it will be understood that variations and modifications can be effected within the spirit and scope of the invention.

We claim:

1. Apparatus for locating a sheet, moving along a travel path defined by a guide and a parallel support, at a registration position in said path, one surface of such sheet being disposed substantially parallel to said support during sheet movement, said apparatus comprising:

resilient means selectively movable into said path upstream of said registration position for applying a deceleration force to such surface, urging such sheet against said support, to retard such sheet approaching said registration position; and means for moving said resilient means into and out of said path so that said resilient means engages such sheet when said resilient means is in said path to locate such sheet at said registration position, and disengages such sheet when said resilient means is out of said path whereby further movement of such sheet along said path is unimpeded.

2. The invention of claim 1 wherein said deceleration force has a component that is substantially parallel to such surface of such sheet and a component that is substantially normal to such surface.

3. The invention of claim 2 wherein said resilient means has a configuration relative to said path, when in said path, which increases the magnitude of said components of said deceleration force on such surface as such sheet approaches the registration position.

4. Apparatus for sequentially locating sheets moving seriatim along a travel path at a registration position in said path, such sheets having a surface disposed substantially parallel to said path, said apparatus comprising:

means selectively movable into said path upstream of said registration position for applying a deceleration force to such surface to retard such sheets approaching said registration position; said deceleration force having a component that is substantially parallel to such surface, and a component that is subsantially normal to such surface and is greater in magnitude than the parallel component; said force applying means being configured to increase the magnitude of said components, at different rates, as such sheets approach said registration position; and means for moving said force applying means into and out of said path so that said resilient means engages such sheets when said resilient means is in said path to locate such sheets at said registration position, and disengages such sheets when said resilient means is out of said path whereby further movement of such sheets is unimpeded along said path.

5. The invention of claim 4 wherein said force applying means comprises a resilient member interposed between said path and said moving means, said resilient member being contacted by said moving means on the side of said resilient member opposite said path to move said resilient member from a position out of said path to a position in said path.

6. The invention of claim 4 in which said apparatus further includes means for guiding such sheets in said path, said guiding means defining at least one opening having marginal edges with at least a portion thereof extending transversely of said path adjacent to said registration position; and wherein said force applying means comprises a deflectable member attached to said guide means adjacent to at least one marginal edge of said opening for covering said opening, and said moving means comprises an extensible member mounted for movement through said opening to move said deflectable member into said path.

7. The invention of claim 6 wherein said guide means defines a plurality of openings, at least one of said openings being located on one side of the centerline of said path and at least one other of said openings being located on the opposite side of the centerline; and further wherein a plurality of deflectable members are attached to said guide means to cover said plurality of openings respectively, and a plurality of extensible members are mounted for movement through said plurality of openings respectively, whereby alignment of such sheets being sequentially located in said registration position about said centerline is facilitated.

8. The invention of claim 7 in which said sheets, located in said registration position, are illuminated to obtain a reflected light image thereof; and wherein said deflectable members are thin sheets of material having a low coefficient of friction and a highly reflective surface finish to optically mask said respective openings from illumination.

9. The invention of claim 8 wherein said deflectable members are resilient flexible membranes attached to said guide means adjacent to said marginal edges of said respective openings.

10. In an apparatus for locating a moving sheet at a registration position in a path, said apparatus including means for guiding such sheets in said path, said guide means comprising a plate spaced from and parallel to a transparent sheet supporting surface to define said path therebetween, said plate having at least one opening therein, sheet registration means selectively movable through said opening to locate such sheet in said registration position for illumination through the transparent surface to obtain a reflected light image thereof, the improvement comprising:

means interposed between said registration means and said path and attached to said guide means for covering said opening to mask the opening and prevent illumination from reaching said registration means.

11. A method for locating a sheet moving along a travel path at a registration position in the path, such sheet having a surface which is substantially parallel to said path, the method comprising the steps of:

engaging such surface of the sheet before the sheet reaches the registration position to apply a force to such surface to decelerate the sheet, said force having a component that is substantially parallel to the surface and a component that is substantially normal to the surface and is greater in magnitude than said parallel component;

increasing the deceleration force applied to such surface as the sheet approaches said registration position such that said parallel component increases at a different rate than said normal component; and releasing said force from such surface of the sheet after the sheet reaches the registration position so that further movement of the sheet along the path is unimpeded.

12. The invention of claim 11 wherein in the step of increasing the deceleration force, said parallel component increases at a faster rate than said normal component.

* * * * *